US008268523B2

(12) United States Patent
Hasegawa et al.

(10) Patent No.: US 8,268,523 B2
(45) Date of Patent: Sep. 18, 2012

(54) BLACK COLOR MATERIAL AND TONER

(75) Inventors: Shinji Hasegawa, Kanagawa (JP); Minquan Tian, Kanagawa (JP); Yuka Ito, Kanagawa (JP); Kazunori Anazawa, Kanagawa (JP); Kazuhiko Hirokawa, Kanagawa (JP); Takashi Matsubara, Kanagawa (JP); Kazunaga Horiuchi, Tokyo (JP); Tomoko Miyahara, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 580 days.

(21) Appl. No.: 12/178,886

(22) Filed: Jul. 24, 2008

(65) Prior Publication Data

US 2009/0081574 A1 Mar. 26, 2009

(30) Foreign Application Priority Data

Sep. 25, 2007 (JP) ..... 2007-248013

(51) Int. Cl.
*G03G 9/09* (2006.01)

(52) U.S. Cl. ..... 430/108.21; 106/31.49; 106/31.78

(58) Field of Classification Search ..... 430/108.21; 106/31.49, 31.78
See application file for complete search history.

(56) References Cited

U.S. PATENT DOCUMENTS 6,514,295 B1 * 2/2003 Chandler et al. ..... 8/607
6,913,864 B2 * 7/2005 Shimizu et al. ..... 430/108.6
2004/0255821 A1 12/2004 Mizuguchi et al.
2005/0016420 A1 1/2005 Mizuguchi et al.
2005/0039636 A1 2/2005 Matsumoto

FOREIGN PATENT DOCUMENTS

GB 2231166 A * 11/1990
JP 2002-20647 A 1/2002
JP 2003-41144 A 2/2003
JP 2003-41145 A 2/2003
JP 2005-513228 A 5/2005
WO WO 03079339 A1 * 9/2003

OTHER PUBLICATIONS

Yagi et al. "Syntheses and applications of squarylium dyes", Functional Dyes, chapter 6, pp. 215-255, Elsevier (Mar. 2006).*
Diamond, Arthur S & David Weiss (eds.) Handbook of Imaging Materials, 2nd ed.. New York: Marcel-Dekker, Inc. (Nov. 2001) pp. 178-182.*
Beverina, Luca, et al. "Indolic Squarines as Two-Photon Absorbing Dyes in the Visible Region: X-ray Structure, Electrochemical, and Nonlinear Optical Characterization" Chemistry of Materials, vol. 20, pp. 3242-3244 (2008).*
Handbook on Organic Pigments, edited by Color Office, 2006.

* cited by examiner

*Primary Examiner* — Christopher Rodee
(74) *Attorney, Agent, or Firm* — Sughrue Mion, PLLC

(57) ABSTRACT

A black color material includes a squarylium compound represented by the following formula (1); and a blue color material:

(1)

4 Claims, 3 Drawing Sheets

BLACK COLOR MATERIAL AND TONER

CROSS-REFERENCE TO RELATED APPLICATIONS

This application is based on and claims priority under 35 USC 119 from Japanese Patent Application No. 2007-248013 filed on Sep. 25, 2007.

BACKGROUND

Technical Field

The present invention relates to a black color material and a toner.

SUMMARY

According to an aspect of the invention, there is provided a black color material including a squarylium compound represented by the following formula (1); and a blue color material:

(1)

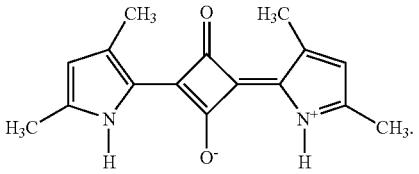

BRIEF DESCRIPTION OF THE DRAWINGS

Exemplary embodiment(s) of the present invention will be described in detail based on the following figures, wherein.

DETAILED DESCRIPTION

Figure 1:
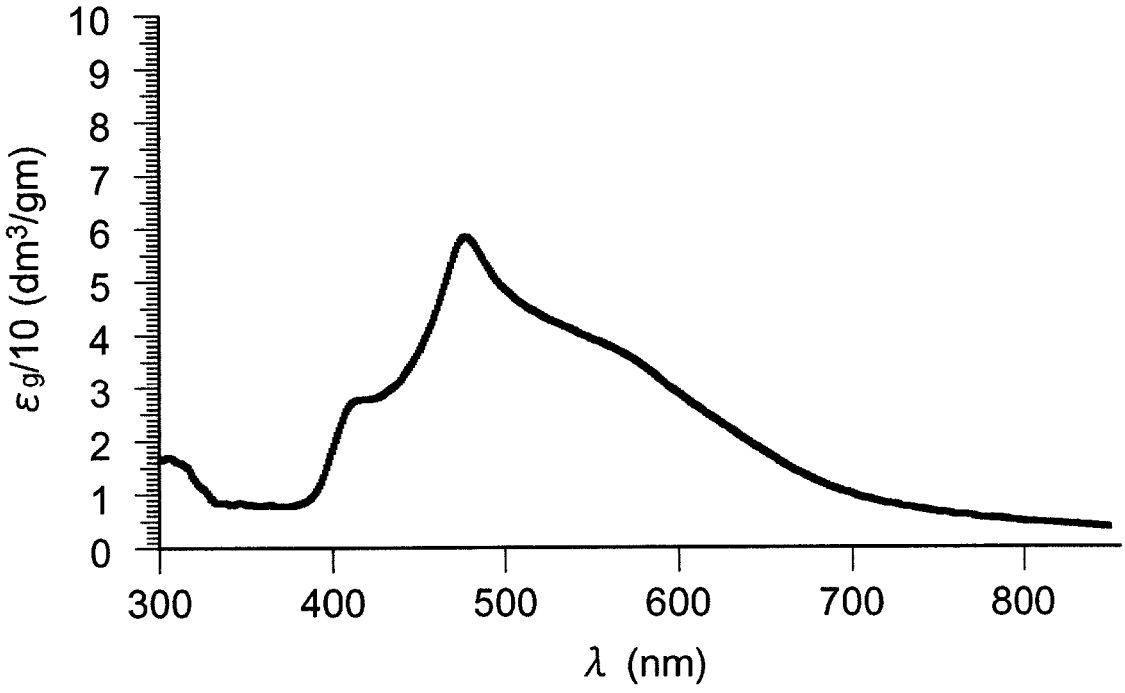
FIG. 1 is a graph showing an absorption spectrum of solid fine particles of the squarylium compound of the formula (1) prepared in Example 1.

The black color material according to the invention includes a squarylium compound represented by the following formula (1).

(1)

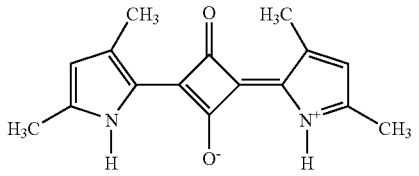

The squarylium compound included in the black color material may be in a state that molecules of the compound represented by the formula (1) associate regularly with each other to form crystal phases or they associate irregularly with each other to form amorphous phases. In addition, the black color material of the invention can include the squarylium compound in a state that those phases are mixed together. The compound in such a state can be formed by mixing a solution prepared by dissolving the compound in an organic solvent with a poor solvent such as water and precipitating the compound (reprecipitation), or by crushing the compound physically by means of a beads mill or the like. The black color material including the compound in such an association state can show its absorptivity in a wider wavelength portion of the visible region as compared with the black color material including the compound by the formula (1) dissolved or dispersed in a medium, such as a liquid or a resin, in a molecular state (in a state free of association and aggregation).

When the black color material includes molecules of the compound represented by the formula (1) in a state of association, the content of molecules of the compound in a state of association can be adjusted to 80 mass % or above with respect to the total molecules of the compound included in the black color material.

In addition, the molecules of the compound represented by the formula (1) in a state of association can have crystallinity.

Further, the black color material of the invention can include the compound represented by the formula (1) in the form of particles. These particles can include the molecules of the compound represented by the formula (1) in a state of association. The diameter (median diameter d50) of these particles is preferably within the range of 20 nm to 300 nm. When the diameter of particles is within this range, light scattered from the particle surfaces can be reduced and the color density can further be heightened. These particles can be kept in a satisfactory dispersion state when dispersed in a medium, such as water, a vehicle or a polymer resin, with the aid of a dispersant including a surfactant.

In the case of using the present black color material for the purpose of information recording materials, the median diameter (d50) of the color material is preferably within the range of 50 nm to 300 nm.

The mixing ratio by weight of the squarylium compound of the formula (1) to a blue color material (the weight of the squarylium compound:the weight of a blue color material) can be chosen from a range of 90:10 to 10:90 according to the absorptivity of the blue color material used, and a wide variety of mixing ratios are feasible.

The squarylium compound of the formula (1), 1-(3,5-dimethyl-pyrrole-2-yl)-3-(3,5-dimethyl-pyrrolium-2-ylidene)-cyclobutene-2-one-4-olate, can be synthesized in accordance with, e.g., the method described in *Angewandte Chemie International Edition in English*, Volume 4, Issue 8, (1965), p.694. This reference contains such descriptions that the squarylium compound can be obtained by subjecting an ethanol solution of 2:1 by mole mixture of 2,4-dimethylpyrrole and a squaric acid (3,4-dihydroxy-3-cyclobutene-1,2-dione) to reaction for several hours under reflux with dehydration at 70° C., cooling the reaction solution to room temperature, washing it with ethanol, water and ethanol/ether in succession, and then recrystallizing the reaction product from chloroform.

Alternatively, the squarylium compound of the formula (1) is produced by the following method, and can be obtained in the form of particles.

To begin with, the pyrrole compound corresponding to the pyrrole substitution moiety in the structure represented by the formula (1) and the squaric acid are allowed to react with each other in an organic solvent, such as ethanol, under heating in accordance with the method described in the paper entitled "Cyclotrimethine Dyes Derived from Squaric Acid" (A.

Treibs & K. Jacob, *Angewandte Chemie International Edition in English*, Volume 4, Issue 8, (1965), p. 694). The compound obtained by the reaction is dissolved in a hydrophilic organic solvent freely miscible with water in arbitrary proportions, such as THF, diethylamine, acetone or ethanol, thereby preparing a compound solution.

Then, the compound solution prepared is injected into stirred ice-cold distilled water with a syringe or the like, and thereby a precipitate is obtained. Herein, the particle diameter of the precipitate can be adjusted to the desired range by controlling the concentration of the compound of the formula (1) in the compound solution, the injection speed of the compound solution, the amount of distilled water used, the temperature of distilled water used and the stirring speed. The precipitate obtained is filtered off, washed with distilled water, and then vacuum-dried to yield particles of the compound represented by the formula (1).

The squarylium compound of the formula (1) in a state of association has an absorption band of high absorptivity in a wide portion of the visible region which corresponds to the region covering the sum of absorption band widths of magenta and yellow color materials, and its absorption coefficient is on the same level as those of magenta and yellow color materials, so it can deliver high color density and has color performance comparable with the combination of two kinds of color materials, namely a magenta color material and a yellow color material.

Therefore, in comparison with the mixed CMY black which requires for three kinds of color materials, generally cyan, magenta and yellow color materials, to be mixed for black color formation, the black color material of the invention can deliver black color formation of high color density and outstanding blackness by use of two kinds of color materials, the squarylium compound of the formula (1) and a blue color material, at the minimum.

The blue color material is not limited to particular one, and may be any of commonly-used blue color materials. Blue color materials are known as color materials having excellent light fastness. Examples of a blue color material usable herein include commonly-used blue pigments, such as Phthalocyanine Blue, Brilliant Blue lakes (PB1, PB24) and naphthol AS derivatives (PB25). The use of a phthalocyanine pigment, such as Phthalocyanine Blue, in particular is preferred in point of blackness and light fastness of the black color material obtained. Examples of the color index number of blue pigment usable herein include PB17:1, PB24, PB24:1, PB25, PB26, PB27, PB56, PB60, PB61, PB62, PB63, PB75, PB79 and PB80. And examples of the color index number of phthalocyanine pigment usable here in include PB15, PB15:1, PB15:2, PB15:3, PB15:4, PB15:5, PB15:6 and PB16.

In addition to the squarylium compound of the formula (1) and a blue color material, other compounding ingredients can be incorporated in the present black color material for the purpose of adjusting color tone and so on. For example, usually-compounded ingredients including a rosin derivative, a surfactant, a dispersant and a synergist, may be incorporated in the black color material of the invention. Alternatively, the color material may be surface-treated in advance with those ingredients.

In the toner of the invention, usually-compounded ingredients including colorants other than the squarylium compound of the formula (1) and a blue color material, an infrared absorbing material, a charge controlling agent and wax can be arbitrarily incorporated in addition to the black color material and a binder resin.

The binder resin of the toner is not limited to particular one, and any of thermoplastic resins including various kinds of natural or synthetic polymers can be used as the binder resin. For example, epoxy resins, styrene-acrylic resins, polyamide resins, polyester resins, polyvinyl resins, polyolefin resins, polyurethane resins and polybutadiene resins can be used alone or as combinations of two or more thereof, provided that they each have a weight-average molecular weight of about 1,000 to about 100,000 and a melting temperature of 50° C. to 250° C. Of these resins, styrene-acrylic resins and polyester resins in particular are suitable from the viewpoints of color material dispersing properties and thermal fixing efficiency.

The content of the black color material in the toner of the invention is preferably from 1 to 15 parts by mass, far preferably from 3 to 10 parts by mass, per 100 parts by mass of binder resin from the viewpoint of attaining satisfactory charging characteristics and thermal fixing efficiency.

The toner of the invention has no particular restriction on colorants which can be arbitrarily added thereto in addition to the squarylium compound of the formula (1) and a blue color material, and the colorants added may be any of dyes, pigments and the like. In the case of black toner, for example, carbon black, mixed CMY black or soon can be used as a colorant. When colorants other than the squarylium compound of the formula (1) and a blue color material are incorporated in the black color material of the invention, the content of colorants is preferably from 1% to 15% by mass, far preferably from 3% to 10% by mass, with respect to the total mass of the toner.

When the toner is used as flash fixing toner or the like, an infrared absorbing material may be incorporated therein. Examples of an infrared absorbing material usable herein include aluminum salts, indium-oxide type metal oxides, tin-oxide type metal oxides, zinc-oxide type metal oxides, cadmium stannate, specific amide compounds, naphthalocyanine and phthalocyanine compounds, cyanine compounds, and lanthanide compounds. In addition to these compounds, black pigments including carbon black, titanium black, ferrite, magnetite and zirconium carbide can also be used. These infrared absorbing materials may be used alone or as mixtures of two or more thereof.

The charge controlling agent has no particular restriction so long as it has an ability to impart electrostatic charge to the toner. Examples of a suitably-used positive charge controlling agent include quaternary ammonium salts, Nigrosine dyes and triphenylmethane derivatives, and examples of a suitably-used negative charge controlling agent include naphtholic acid-zinc complex, salicylic acid-zinc complex, and boron compounds. Depending on the chemical species, such a charge controlling agent is generally added in an amount of the order of 1 to 10 mass % with respect to the total mass of the toner.

As to the wax, a wide variety of wax materials including natural wax and synthetic wax can be used. More specifically, petroleum wax including paraffin wax and microcrystalline wax, mineral wax including Fischer-Tropsch wax and montan wax, vegetable wax including carnauba wax, animal wax including beeswax and lanolin, synthetic wax including polyolefins, such polyethylene and polypropylene, fatty acid esters, amide wax and modified polyolefins, and other compounds including terpene compounds and polycaprolactone can be widely used alone or as mixtures of two or more thereof. Depending on the type, such wax is added in an amount of the order of 1 to 10 mass % with respect to the total mass of the toner.

To the toner, external additives may be added. Commonly-used materials can be widely used as the external additives, with examples including inorganic fine particles, such as silica, titania, alumina and zinc oxide, these inorganic fine particles treated so as to have hydrophobicity, and particles of resin, such as polystyrene, PMMA or melamine resin.

The toner of the invention can be manufactured according to the same methods as commonly used for toner manufacturing. Exemplary embodiments of toner manufacturing are illustrated below.

When the toner is manufactured by melt kneading and pulverizing method, toner constituents including a binder resin and the present black color material and further, if needed, a colorant other than the squarylium compound of the formula (1) and a blue color material, an infrared absorbing material, wax and a charge controlling agent are mixed together, and then melt-kneaded by means of a kneader or an extrusion machine. Thereafter, the melt-kneaded substance is coarsely pulverized, and then finely pulverized with a jet mill or the like, and further put through a pneumatic classifier, thereby yielding toner particles having the intended particle sizes. Furthermore, external additives are added to the toner particles. Thus, final toner is completed.

Alternatively, it is possible to manufacture the toner by use of a polymerization method. To this case, a suspension polymerization method and an emulsion polymerization method are mainly applicable. The present black color material can assume a state of water-dispersible slurry suitable for a process in the emulsion polymerization method. Therefore, the toner is preferably chemical toner based on the emulsion polymerization method.

When the toner is manufactured by a suspension polymerization method, a monomer composition is prepared by mixing a monomer such as styrene, butyl acrylate or 2-ethylhexyl acrylate, a cross-linking agent such as divinyl benzene, a chain transfer agent such as dodecyl mercaptan, the present black color material, a polymerization initiator, and further, when required, a colorant other than the squarylium compound of the formula (1) and a blue color material, a charge controlling agent, an infrared absorbing material and wax. Then, the monomer composition is put into an aqueous phase in which a suspension stabilizer, such as tripotassium phosphate or polyvinyl alcohol, and a surfactant are incorporated, and made into an emulsion by means of a rotor-stator emulsion machine, a high-pressure emulsion machine or an ultrasonic emulsion machine, and further subjected to polymerization by heating. After the polymerization is completed, particles obtained are washed and dried, and thereto external additives are added. Thus, final toner particles are obtained.

When the toner is manufactured by an emulsion polymerization method, resin particles are prepared by adding a monomer, such as styrene, butyl acrylate or 2-ethylhexyl acrylate, and a surfactant as required, such as sodium dodecylbenzenesulfonate, to water in which a water-soluble polymerization initiator, such as potassium persulfate, is dissolved, and subjecting the monomer to polymerization under heating with stirring. Then, particles of an infrared absorbing material, wax and so on are added to a suspension in which the resin particles are dispersed, and these particles are subjected to heterogeneous agglomeration by controlling the pH of the suspension and the stirring strength and temperature. Next, the thus prepared heterogeneous agglomerates are fused by heating at a temperature equal to or higher than the glass transition temperature of the resin to yield toner particles. Thereafter, the toner particles are washed and dried, and thereto external additives are added. Thus, final toner particles are obtained. Coloring of the toner particles may be performed by fusing heterogeneous agglomerates, then mixing them with a slurry prepared by dispersing into water the present black color material and, if desired, a colorant other than the squarylium compound of the formula (1) and a blue color material, and further agglomerating them with the aid of a polyvalent metal flocculant, or it may be performed by agglomerating the present black color material, together with a colorant other than the squarylium compound of the formula (1) and a blue color material as appropriate, concurrently with the formation of heterogeneous agglomerates.

The toner manufactured according to an exemplary embodiment of the invention can be used as a one-component developer as it is, or can be made into a two-component developer by mixing with a carrier. Examples of a carrier usable in the two-component developer include heretofore known magnetite, ferrite and iron powder.

Because of its high color density (especially per unit weight), the present black color material is suitable as a material of black toner. Even when the black-color material content in the present black toner is adjusted to a low value, say, 6.7 wt %, superior viewability can be attained as compared with the case of using mixed CMY black.

The present black color material is therefore useful as a black material included in information recording materials. There have so far been many cases where carbon black was used as pigment in electrophotographic black toner for copier use or the like. However, carbon black added in a large amount adversely affects electrostatic chargeability of the toner. On the other hand, mixed CMY black and burned perylene black pigments are low in color density as compared with carbon black. In contrast to those black color materials, the present black color material can offer the same level of gram absorption coefficient (absorption coefficient per unit weight) in the visible region as carbon black has, accordingly, the present color material can be used as an alternative to carbon black, and allows realization of electrophotographic black toner having not only excellent color density but also high light fastness even though the toner is free of carbon black or has a low carbon-black content, which is difficult to attain by use of the mixed CMY black or the burned perylene black pigments.

The utilization of the present black color material as a color material for toner is illustrated above by way of example. Further, it is also possible to use the present black color material as a black material having transparency to near-infrared rays in the following manner, because the present black color material not only has a broad absorption band in the visible region but also shows transparency to near-infrared rays.

For example, the present black color material can be utilized in the area of document security. More specifically, an image forming method in which some of letters and images are formed with carbon black and the rest are formed with the present black color material can be cited as an example. The images formed by such a method merely look "black" letters and images when viewed in a usual manner. However, when viewed by means of a detector having sensitivities only to near-infrared rays, the part of the present color material, or the part of the near-infrared-transparent black material, becomes transparent. The present black color material allows embedment of information codes and secret letters in "black" images by taking advantage of the characteristics thereof, and images superior in prevention of information leakage can be formed.

On the other hand, the present black color material can also be used as a heat-ray absorption adjusting agent for flash fixing toner. More specifically, when images formed as usual by use of black toner including carbon black and a binder resin are fixed with a flash lamp, it sometimes occurs that the black toner absorbs an excess of heat rays and causes an excess increase in resin temperature. As a result, it becomes difficult to achieve equalization of the degree of welding of the resin by flash fixing in various colors when images are formed with colored toner of various colors including cyan, magenta and yellow colors on the same paper surface as the black toner images are formed. By contrast, incorporation of the present black color material into flash fixing toner makes it possible to control the quantity of heat-ray absorption by the toner while keeping sufficient blackness of images, and allows prevention of an excess increase in resin temperature at the time of flash fixing. To be concrete, the present black color material can be used suitably as a heat-ray absorption adjusting agent for flash fixing black toner containing polyester resin, styrene-acrylic resin or the like as binder resin.

In addition, the present black color material can be used suitably as a black material for coloration of resin parts to be bonded together by a laser transmission welding method.

The laser transmission welding method is an art of bonding resin parts together by using laser beams in the near-infrared region as a heat source. More specifically, a resin part capable of transmitting laser beams (light-transparent resin part) is overlaid on a resin part capable of absorbing laser beams (light-absorbing resin part), and irradiated with laser beams under pressure is applied to faces intended to be bonded together. At this time, the laser beams pass through the light-transparent resin part, and generates heat in the vicinity of the boundary surface between the light-absorbing resin part and the light-transparent resin part. By this heat, the resin parts are molten and bonded together.

In the laser transmission welding method, a color material of dye type is commonly used as the black material incorporated into a light-transparent resin part in consideration of laser-beam loss. By contrast, incorporation of the present black color material into a light-transparent resin part causes no loss of perviousness to laser beams and allows black coloration having sufficient color density and higher light fastness than offered by incorporation of dyes. In the case of a black article into which the present black color material is incorporated, laser beams can reach to a bonding region in the interior of the article, so bonding inside the article becomes possible too.

The present black color material can also be utilized as a color material to be incorporated into agricultural lightproof film. The agricultural lightproof film is black film for covering the ground in which crops are to grow, and the use of the present black color material in film makes it possible not only to filter out visible light and prevent proliferation of weeds but also to impart a function of warming the ground to the film by allowing near-infrared rays and infrared rays to pass through.

By taking advantage of its properties, the present black color material can also be used suitably as black color materials for light controlling glass, light shielding glass, ink, paint, inkjet ink, coloration of rubber and plastic, black matrix, stationary, color filter and dyeing of spun fiber.

Furthermore, the present black color material can also be used in the form of thin film. In other words, this thin film shuts out and attenuates visible light on one hand and allows infrared rays to pass through on the other. Therefore, thin film using the present black color material is suitable for optical-filter purpose or the like. Such thin film can be formed, e.g., by spin-coating a glass substrate or the like with a color material solution prepared by dissolving or dispersing the present black color material in a solvent such as THF or diethylamine.

EXAMPLES

The invention will now be illustrated in more detail by reference to the following examples, but these examples should not be construed as limiting the scope of the invention.

Example 1

<Synthesis of Squarylium Compound>

An ethanol solution in which 1 gram (10.5 millimole) of 2,4-dimethylpyrrole (D2848, trade name, produced by Tokyo Chemical Industry Co., Ltd.) and 0.63 gram (5.2 millimole) (mol rate 2:1) of a squaric acid (3,4-dihydroxy-3-cyclobutene-1,2-dione, produced by KYOWA HAKKO KOGYO Co., Ltd.) are mixed together undergoes reaction for 4 hours under reflux with dehydration at 78.2° C. After the solution temperature is restored to room temperature, a precipitate formed by the reaction is filtered off, washed with ethanol, water and ethanol/ether in succession, and recrystallized from ethanol. The molecular weight of the product thus obtained is determined to be 268 by mass spectrum measurement (SHIMADZU Mass Chromatograph Spectrometer GCMS-QP5000), and the product obtained is identified as the squarylium compound of the formula (1). And an absorption spectrum of the product molecules dissolved in tetrahydrofuran solvent (measuring instrument: HITACHI U-4100 Spectrophotometer) shows an absorption maximum at a wavelength of 559 nm ($\lambda$max=559 nm).

<Preparation of Aqueous Slurry Solution of Squarylium Compound>

A 0.5 mM THF solution of the squarylium compound of the formula (1) in an amount of 40 mL is mixed without a rest into 2 L of ice-cold distilled water by means of a microsyringe (reprecipitation method). After a lapse of several minutes, the temperature of the resultant mixture is restored to room temperature, filtered off, washed with distilled water, and then vacuum-dried. The thus obtained fine particles in an amount of 3.91 mg, together with 19.4 μL of 12% Triton X-100 (nonionic surfactant, a product of Nacalai Tesque, Inc.) and 2.33 mL of distilled water, is subjected to ultrasonic dispersion (ultrasonic power: 4-5 W, use of a ¼ inch horn, irradiation time: 30 minutes), thereby preparing an aqueous slurry solution of the squarylium compound. The concentration of fine particles of the squarylium compound of the formula (1) in the aqueous slurry solution thus prepared is 0.165 wt %, and the diameter of the particles is 300 nm as expressed in terms of median diameter d50.

<Preparation of Aqueous Slurry Solution of Black Color Material>

A 0.165 wt % aqueous slurry solution of phthalocyanine blue color material is prepared from a commercially available phthalocyanine blue color material (Color Index number: PB15, absorption region: vicinity of 650 to 750 nm). To this solution, the aqueous slurry solution of the squarylium compound of the formula (1) (concentration: 0.165 wt %) is added in such an amount that the mixing weight ratio between them (weight of the squarylium compound:weight of the blue color material) becomes 1:1, thereby preparing an aqueous slurry solution of black color material.

<Preparation of Coated Paper (Sample for Evaluation Purpose)>

The thus prepared aqueous slurry solution of black color material is mixed with an aqueous solution in which styrene-acrylic resin latex is dispersed (an aqueous solution in which a resin produced from styrene, n-butyl acrylate and acrylic acid by emulsion polymerization is dispersed), and thereto an aluminum polychloride flocculant is added and stirred. Thus, a dispersion liquid of the black color material/resin mixture is prepared. This dispersion liquid of the mixture is filtered off, and deposits are made to build up on filter paper and subjected to thermo compression bonding at 120° C., thereby preparing coated paper covered with a coating film of the black color material/resin mixture. Herein, the total amount of the resin (solid matter) and the black color material is adjusted to 4.5 $g/m^2$ and the amount of the black color material is adjusted to 0.45 $g/m^2$ (corresponding to a black color material content of 10 wt %).

Example 2

Another black color material-coated paper is prepared in the same manner as in Example 1, except that the mixing ratio by weight of the aqueous slurry solution of black color material to the aqueous slurry solution of phthalocyanine blue color material (weight of the squarylium compound:weight of the blue color material) is changed to 1:2.

Example 3

Still another black color material-coated paper is prepared in the same manner as in Example 1, except that the mixing ratio by weight of the aqueous slurry solution of black color material to the aqueous slurry solution of phthalocyanine blue color material (weight of the squarylium compound:weight of the blue color material) is changed to 2:1.

Example 4

Further black color material-coated paper is prepared in the same manner as in Example 1, except that the amount of the black color material is adjusted to 0.30 $g/m^2$ (corresponding to a black color material content of 6.7 wt %).

Comparative Example 1

Mixed CMY Black-Coated Paper

Commercially available cyan pigment (Color Index number: PB15), magenta pigment (Color Index number: PR5) and yellow pigment (Color Index number: PY1), which each has particle diameters in a range of 100 to 200 nm in terms of d50, are blended in such proportions that the resultant mixture looks blackest when sensory evaluation is made by visual observation, admixed with a surfactant (Triton X-100, a product of Nacalai Tesque, Inc.), and then subjected to ultrasonic dispersion by means of an ultrasonic homogenizer (VC-130, made by SONICS & MATERIALS, INC., ultrasonic power: 4-5 W, use of a ¼ inch horn, irradiation time: 30 minutes), thereby preparing an aqueous slurry solution of mixed CMY black. Herein, the mixed CMY black concentration in the aqueous slurry solution is 0.165 wt %. This slurry solution is mixed with an aqueous solution in which styrene-acrylic resin latex is dispersed (an aqueous solution in which a resin produced from styrene, n-butyl acrylate and acrylic acid by emulsion polymerization is dispersed), and thereto an aluminum polychloride flocculant is added and stirred, thereby preparing a color material/resin dispersion liquid containing the mixed CMY black as the color material. This dispersion liquid is filtered off, and deposits are made to build up on filter paper and subjected to thermo compression bonding at 120° C., thereby preparing coated paper covered with the mixed CMY black coating. Herein, the total amount of the resin (solid matter) and the color material is adjusted to 4.5 $g/m^2$ and the amount of the color material is adjusted to 0.45 $g/m^2$ (corresponding to a color material content of 10 wt %).

(Performance Evaluation)

<Measurement of Absorption Spectrum (Gram Absorption Coefficient) of Solid Fine Particles>

The aqueous slurry solution of the squarylium compound of the formula (1) prepared in Example 1 (fine particle concentration: 0.165 wt %) is sealed in a quartz cell having an optical path length of 50 μm, and an absorption spectrum thereof is measured with a spectrophotometer HITACHI U-4100. The relationship between the gram absorption coefficient ($\epsilon_g$) and the wavelength (λ) is shown in FIG. 1. As shown in FIG. 1, the squarylium compound of the formula (1) shows a broad absorption band in a wavelength region extending from about 400 nm to about 650 nm, which confirms that the compound has an absorption band comparable to the sum of the band widths of magenta and yellow color materials. In addition, the maximum gram absorption coefficient is about 60 $dm^3$/gcm as shown in FIG. 1, and this value is on the same level as or greater than the maximum gram absorption coefficients of general magenta and yellow color materials (which are generally about 60 $dm^3$/gcm and about 30 $dm^3$/gcm, respectively). These results prove that the squarylium compound of the formula (1) has combined color performance (absorption region and color density) of two kinds of color materials, a magenta color material and a yellow color material.

<Reflection-Spectrum Measurement>

Figure 2:
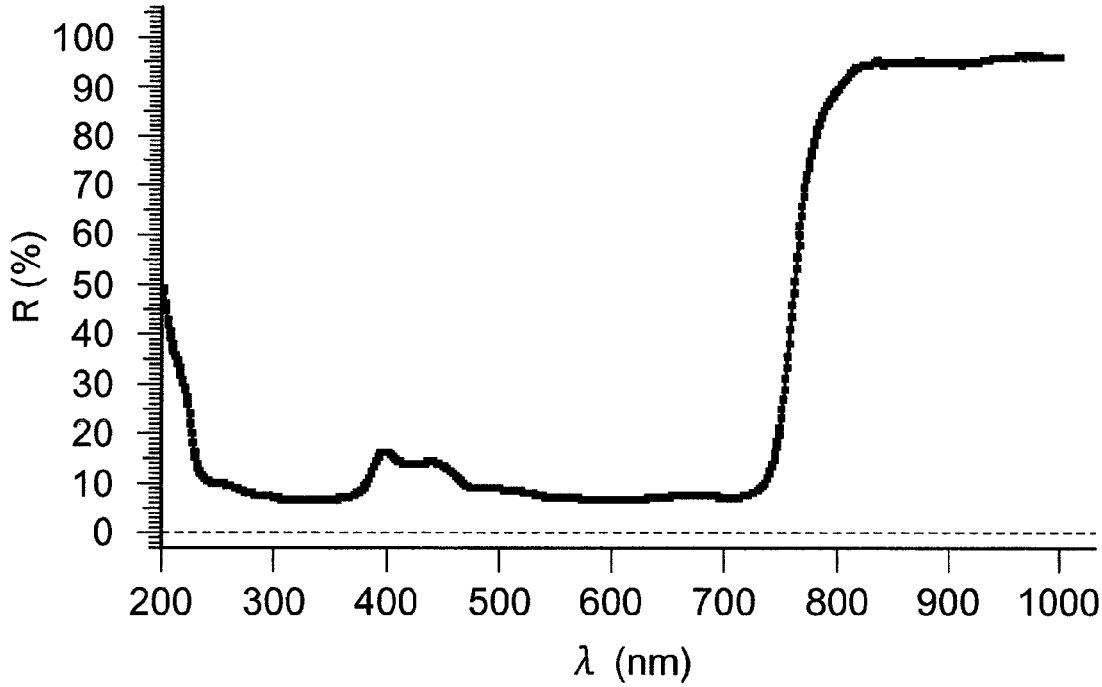
FIG. 2 is a graph showing a reflection spectrum of the sample of Example 1 wherein the black color material prepared in Example 1 is used.

A reflection spectrum of the black color material-coated paper prepared in Example 1 is measured with reference to filter paper by means of a spectrophotometer HITACHI U-4100. The reflection spectrum obtained is shown in FIG. 2. In FIG. 2, the wavelength λ (nm) is plotted as abscissa and the reflectance R(%) as ordinate. The reflection spectrum shown in FIG. 2 illustrates how the black color material of Example 1 is seen when used as the colorant in black toner. As shown in FIG. 2, the reflectance in the whole visible region extending from about 300 nm to about 700 mm stands at a low 8 to 15% owing to a light absorbing action of the black color material prepared in Example 1, so the black color material has high blackness and utilizing suitability as black color material. On the other hand, the reflectance in the near infrared region extending from about 800 nm to about 1,000 nm is 95% or above, and indicates that the black color material prepared in Example 1 has almost no action of absorbing light in the near infrared region (or equivalently, allows near infrared rays to pass through with high efficiency).

<Optical Density (OD) Measurement>

Optical density (OD) measurements in the visible region are made on the resin film of coated paper prepared in Example 1 and that in Comparative Example 1, respectively, by means of a spectrodensitometer (X-Rite 939, made by X-Rite, Inc.), with the filter paper color being taken as a zero density level. Herein, OD=1 means 90% absorption of incident light, and OD=2 means 99% absorption of incident light. Measurement results are shown in Table 1.

TABLE 1

| Color Material | Optical Density |
|---|---|
| Black color material (Example 1) | 1.64 |
| Mixed CMY black (Comparative Example 1) | 1.30 |

As can be seen from Table 1, it is verified that the coated paper using the black color material prepared in Example 1 is very high in optical density (color density) as compared with the coated paper using the mixed CMY black prepared in Comparative Example 1. These measurement results signify that highly effective coloration can be achieved by a reduced amount of color material. At the same time, they indicate that the use of the color material of Example 1 as a colorant of toner allows the color material to more effectively develop its property of having high optical density (being intensely colored) and, when the color material of Example 1 is used as the colorant of black toner, it delivers intense coloration and feasibility of black toner having high visibility.

In the same manner as in Example 1, optical density (OD) measurement is made on coated paper prepared in Examples 2 to 4 each. As the measurement results, it is found that the OD values are 1.65 and 1.66 in Examples 2 and 3 respectively, wherein the mixing weight ratios (weight of squarylium compound:weight of blue color material) are 1:2 and 2:1 respectively, and the OD value in Example 4 is 1.45. All these OD values are higher than the OD value in Comparative Example 1 using the mixed CMY black.

<Evaluation of Light Fastness>

Figure 3:
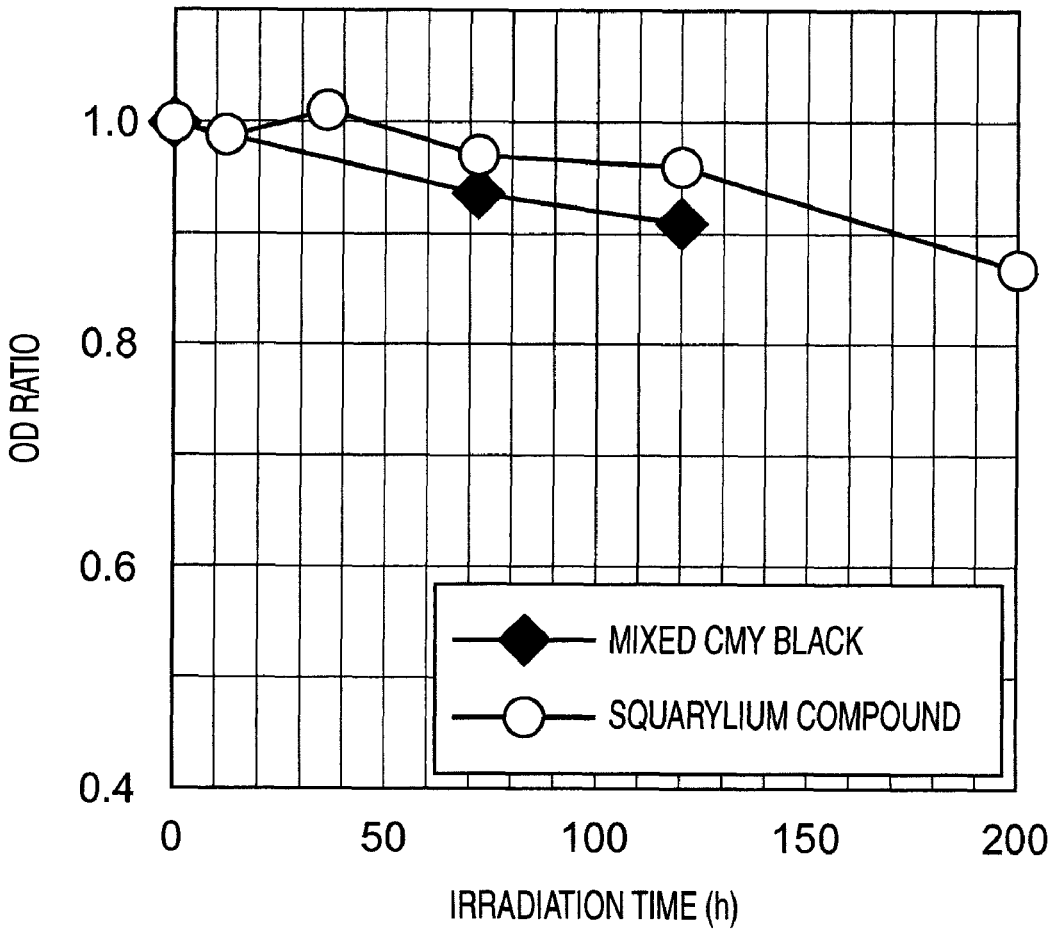
FIG. 3 is a graph showing results of the light fastness tests carried out on the squarylium compound prepared in Example 1 and the mixed CMY black of Comparative Example 1.

Light fastness tests using a xenon lamp (Suntest XLS+, made by Toyo Seiki Seisaku-Sho, Ltd., condition of irradiating light: 100 Klux) are carried out on the coated paper using the squarylium compound of the formula (1) prepared in Example 1 and the coated paper using the mixed CMY black prepared in Comparative Example 1, respectively. Results obtained are shown in FIG. 3.

The OD ratio of a color material evaluated with reference to its initial OD value decreases as the material suffers degradation from irradiated light. As shown in FIG. 3, however, the quantity of decrease caused in OD ratio of the squarylium compound of the formula (1) with increase in irradiation time is smaller than that of the mixed CMY black in Comparative Example 1. This result indicates that the squarylium compound of the formula (1) has better light fastness. Since the blue color material, such as phthalocyanine blue, used in combination with this compound has good light fastness, the light fastness of the black color materials of Examples 1 to 4 are good.

What is claimed is:

1. A black color material comprising:

a squarylium compound represented by the following formula (1); and a blue color material:

(1)

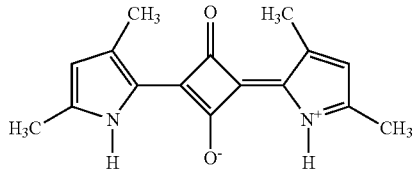

wherein molecules of the squarylium compound associate with each other, and the squarylium compound has an absorption band in a wavelength region extending from 400 nm to 650 nm.

2. The black color material as described in claim 1, wherein the blue color material is a phthalocyanine pigment.

3. A toner comprising:

the black color material as described in claim 1; and a binder resin.

4. The black color material as described in claim 1, wherein a mixing ratio by weight of the squarylium compound of formula (1) to the blue color material is from 90:10 to 10:90.

* * * * *